US008310511B2

(12) United States Patent
Daicho

(10) Patent No.: US 8,310,511 B2
(45) Date of Patent: Nov. 13, 2012

(54) THERMAL PRINTHEAD

(75) Inventor: Shojiro Daicho, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 211 days.

(21) Appl. No.: 12/775,713

(22) Filed: May 7, 2010

(65) Prior Publication Data

US 2010/0283824 A1 Nov. 11, 2010

(30) Foreign Application Priority Data

May 8, 2009 (JP) ..... 2009-113820
May 7, 2010 (JP) ..... 2010-106920

(51) Int. Cl.
*B41J 2/35* (2006.01)

(52) U.S. Cl. ..... 347/211

(58) Field of Classification Search ..... 347/200, 347/205, 209, 211
See application file for complete search history.

(56) References Cited

U.S. PATENT DOCUMENTS 5,791,793 A * 8/1998 Nagahata ..... 347/200
6,236,422 B1 * 5/2001 Nagahata et al. ..... 347/200

FOREIGN PATENT DOCUMENTS

JP 405220998 * 8/1993
JP 2007-106020 4/2007

* cited by examiner

*Primary Examiner* — Kristal Feggins
(74) *Attorney, Agent, or Firm* — Hamre, Schumann, Mueller & Larson, P.C.

(57) ABSTRACT

A thermal printhead includes a substrate, a plurality of heat portions formed on the substrate and arranged in a primary scanning direction, a driver IC provided on the substrate to selectively heat the heat portions, and a cover covering at least part of the driver IC. The cover includes a pair of pinching portions spaced from each other in the primary scanning direction and pinching an end of the substrate in a secondary scanning direction.

20 Claims, 14 Drawing Sheets

THERMAL PRINTHEAD

BACKGROUND OF THE INVENTION

1. Field of the Invention

The present invention relates to a thermal printhead for use as a structural part of a thermal printer.

2. Description of the Related Art

FIG. 29 illustrates an example of conventional thermal printhead (see JP-A-2007-106020, for example). The thermal printhead X illustrated in the figure includes a ceramic substrate 92 and a resin substrate 93 which are attached to a heat dissipation plate 91. On the ceramic substrate 92, a heating resistor 94 and a driver IC 95 extending in the primary scanning direction are mounted. The driver IC 95 selectively heats part of the heating resistor 94. The driver IC 95 is covered by protective resin 96. The driver IC 95 is further covered by a cover 97 as well as the protective resin 96. The cover 97 is prepared by e.g. bending a metal plate and has a cross section which is substantially uniform in the primary scanning direction. The cover 97 is attached, via the resin substrate 93, to the heat dissipation plate 91 by using a screw 98. The provision of the cover 97 prevents thermal paper, which is pressed against the heating resistor 94 by a platen roller Pr, from being damaged by the protective resin 96.

However, the use of the screw 98 to attach the cover 97 increases the number of structural parts of the thermal printhead X. Further, even when the heat dissipation plate 91 is not necessary for the purpose of promoting heat dissipation, the heat dissipation plate 91 or a substitute for the heat dissipation plate needs to be provided to support the cover 97. Moreover, the space for fastening the screw 98 needs to be secured, which undesirably increases the size of the thermal printhead X.

SUMMARY OF THE INVENTION

The present invention has been proposed under the circumstances described above. It is therefore an object of the present invention to provide a thermal printhead which has a smaller number of structural parts and which is more compact.

A thermal printhead provided according to the present invention includes a substrate, a heating resistor formed on the substrate along a primary scanning direction, a driver IC provided on the substrate to partially heat the heating resistor, and a cover covering at least part of the driver IC. The cover includes a pair of pinching portions spaced from each other in the primary scanning direction and each pinching the substrate.

In a preferred embodiment of the present invention, the pinching portions pinch an end of the substrate in a secondary scanning direction.

In a preferred embodiment of the present invention, the pinching portions are so arranged that the driver IC is sandwiched between the pinching portions in the primary scanning direction.

In a preferred embodiment of the present invention, the pinching portions overlap the driver IC in the secondary scanning direction.

In a preferred embodiment of the present invention, at least one of the pinching portions is formed with a through-hole for exposing a surface of the substrate on which the driver IC is provided.

In a preferred embodiment of the present invention, the surface of the substrate on which the driver IC is provided is formed with an electrically conductive film. The electrically conductive film includes a portion positioned closer, in the secondary scanning direction, to an end of the surface in the secondary scanning direction than the through-hole is, and a portion positioned on an outer side of the through-hole in the primary scanning direction. The electrically conductive film is different from the substrate in at least one of hue, chroma and lightness.

In a preferred embodiment of the present invention, the through-hole includes a portion having a cross sectional area that increases as proceeding away from the substrate in a thickness direction of the substrate.

In a preferred embodiment of the present invention, the electrically conductive film is electrically connected to a ground line, and at least one of the pinching portions pinches the substrate together with the electrically conductive film.

In a preferred embodiment of the present invention, the portion positioned on an outer side of the through-hole in the primary scanning direction includes: a retreated portion provided at a position retreated from an end of the substrate in the primary scanning direction; and an extension extending from the retreated portion to reach the end of the substrate in the primary scanning direction.

In a preferred embodiment of the present invention, the through-hole is filled with adhesive material.

In a preferred embodiment of the present invention, the cover includes a thin-wall portion positioned between the pinching portions in the primary scanning direction, and the thin-wall portion covers at least part of the driver IC and is smaller in thickness than the pinching portions.

In a preferred embodiment of the present invention, the thermal printhead further includes a connector provided at an end of the substrate in a secondary scanning direction and electrically connected to the driver IC, where the connector is also positioned between the pinching portions in the primary scanning direction.

In a preferred embodiment of the present invention, the cover includes an inclined portion. The inclined portion is so inclined that, at a position farther from the connector in the secondary scanning direction, the inclined surface is farther from the connector in a normal direction of a surface of the substrate on which the heating resistor is formed.

In a preferred embodiment of the present invention, the thermal printhead further includes a heat dissipation plate attached to a surface of the substrate opposite to the surface on which the heating resistor is formed.

In a preferred embodiment of the present invention, the heat dissipation plate is formed with a bulging portion positioned downstream from the substrate in a printing direction and projecting in a normal direction of the surface of the substrate on which the heating resistor is formed.

In a preferred embodiment of the present invention, the bulging portion projects beyond the substrate in the normal direction.

In a preferred embodiment of the present invention, the bulging portion is formed with an inclined surface that is so inclined as to be deviated toward an opposite of the normal direction as proceeding downstream in the printing direction.

In a preferred embodiment of the present invention, the bulging portion is formed with a side surface oriented upstream in the printing direction and facing an end surface of the substrate.

In a preferred embodiment of the present invention, the heat dissipation plate is formed with a groove that is positioned on an opposite side of the normal direction with respect to the side surface and caves in a direction opposite the normal direction.

In a preferred embodiment of the present invention, the heat dissipation plate is provided at a position avoiding the pinching portions.

Other features and advantages of the present invention will become more apparent from the detailed description given below with reference to the accompanying drawings.

DETAILED DESCRIPTION OF THE PREFERRED EMBODIMENTS

Preferred embodiments of the present invention are described below with reference to the accompanying drawings.

Figure 1:
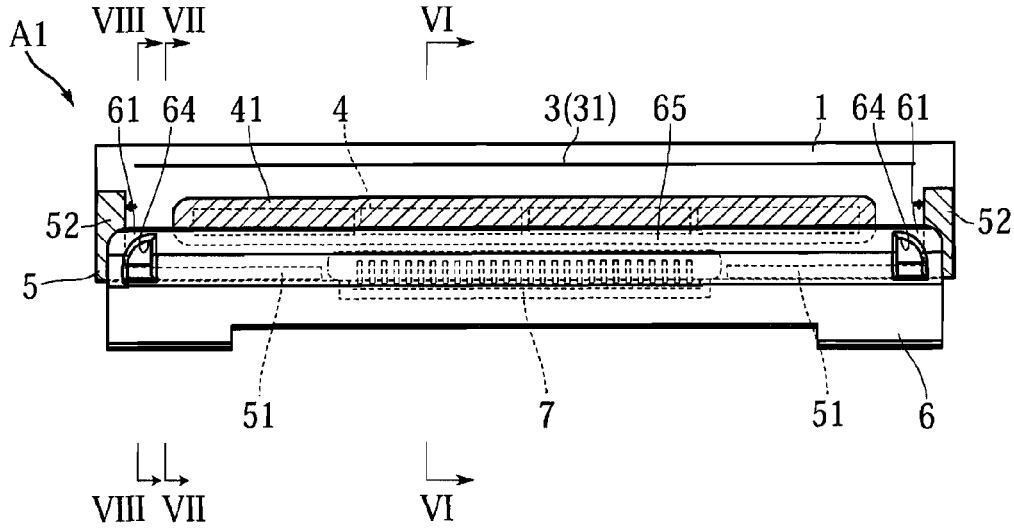
FIG. 1 is a plan view illustrating a thermal printhead according to a first embodiment of the present invention.
Figure 2:
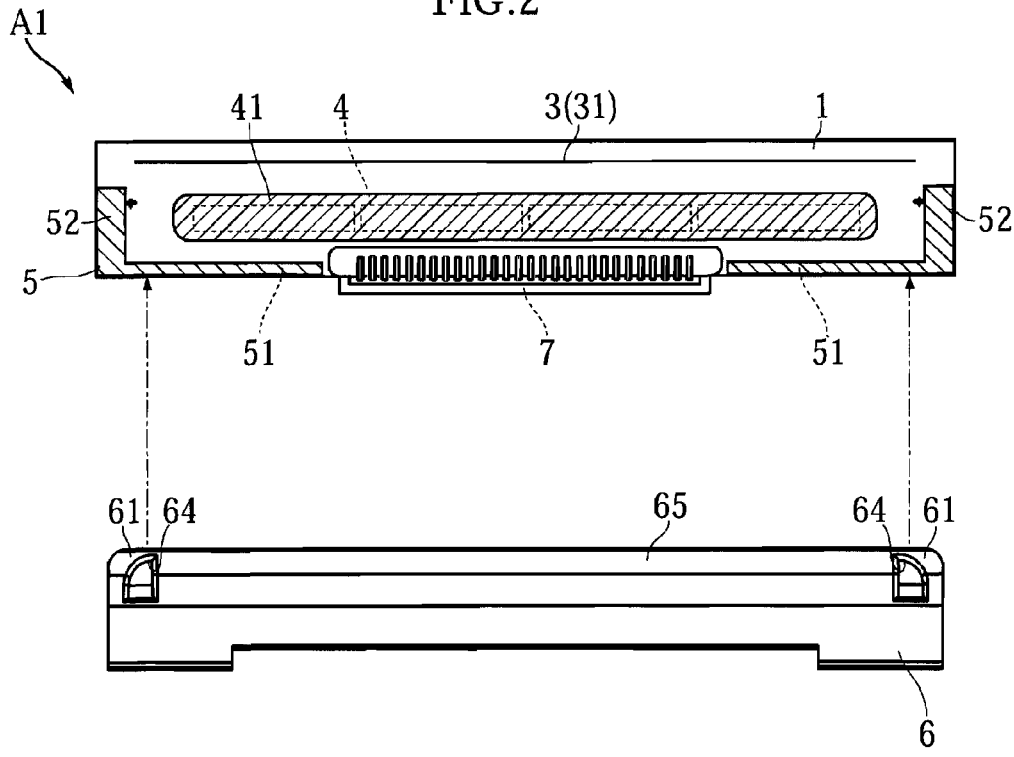
FIG. 2 is an exploded plan view illustrating the thermal printhead according to the first embodiment of the present invention.
Figure 3:
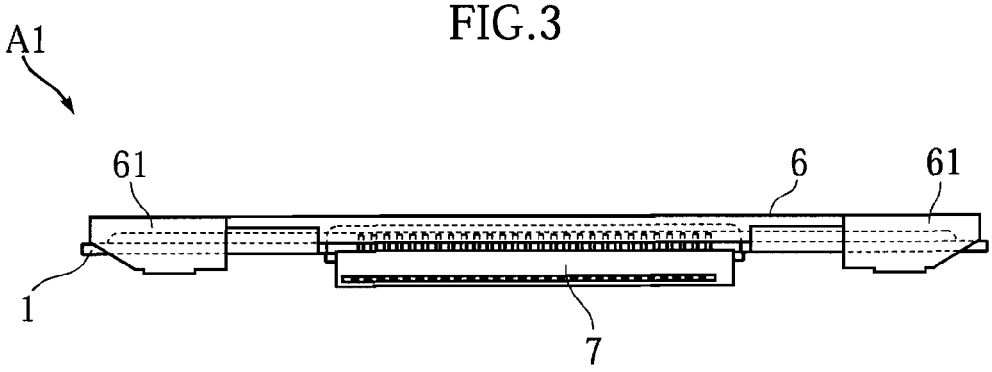
FIG. 3 is a rear view illustrating the thermal printhead according to the first embodiment of the present invention.
Figure 4:
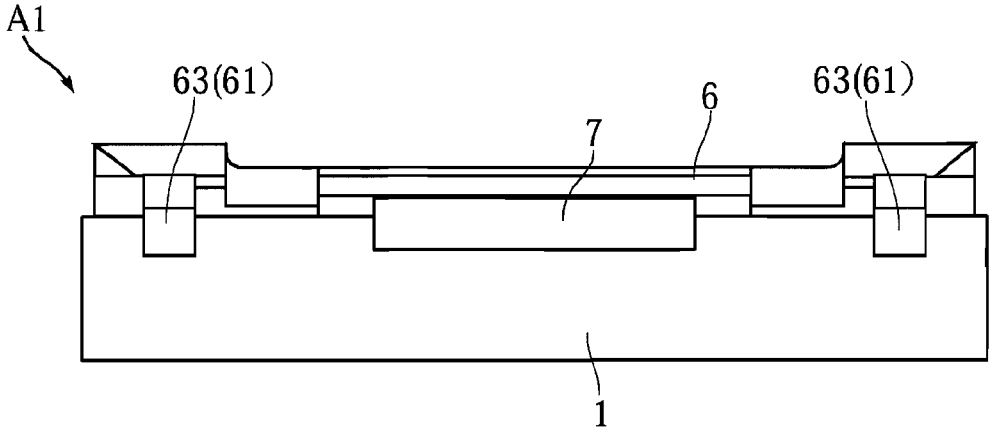
FIG. 4 is a bottom view illustrating the thermal printhead according to the first embodiment of the present invention.

FIGS. 1-8 illustrate a thermal printhead according to a first embodiment of the present invention. The thermal printhead A11 of this embodiment includes a substrate 1, an electrode 2, a heating resistor 3, driver ICs 4 and a cover 6. In FIG. 1, the illustration of the electrode 2 and the adhesive material 69, which is described later, is omitted.

The substrate 1 is an insulating substrate which extends in the primary scanning direction and is rectangular in plan view, and is made of e.g. an alumina ceramic material. On a surface of the insulating substrate 1, an insulating layer called glaze is formed (not shown).

Figure 5:
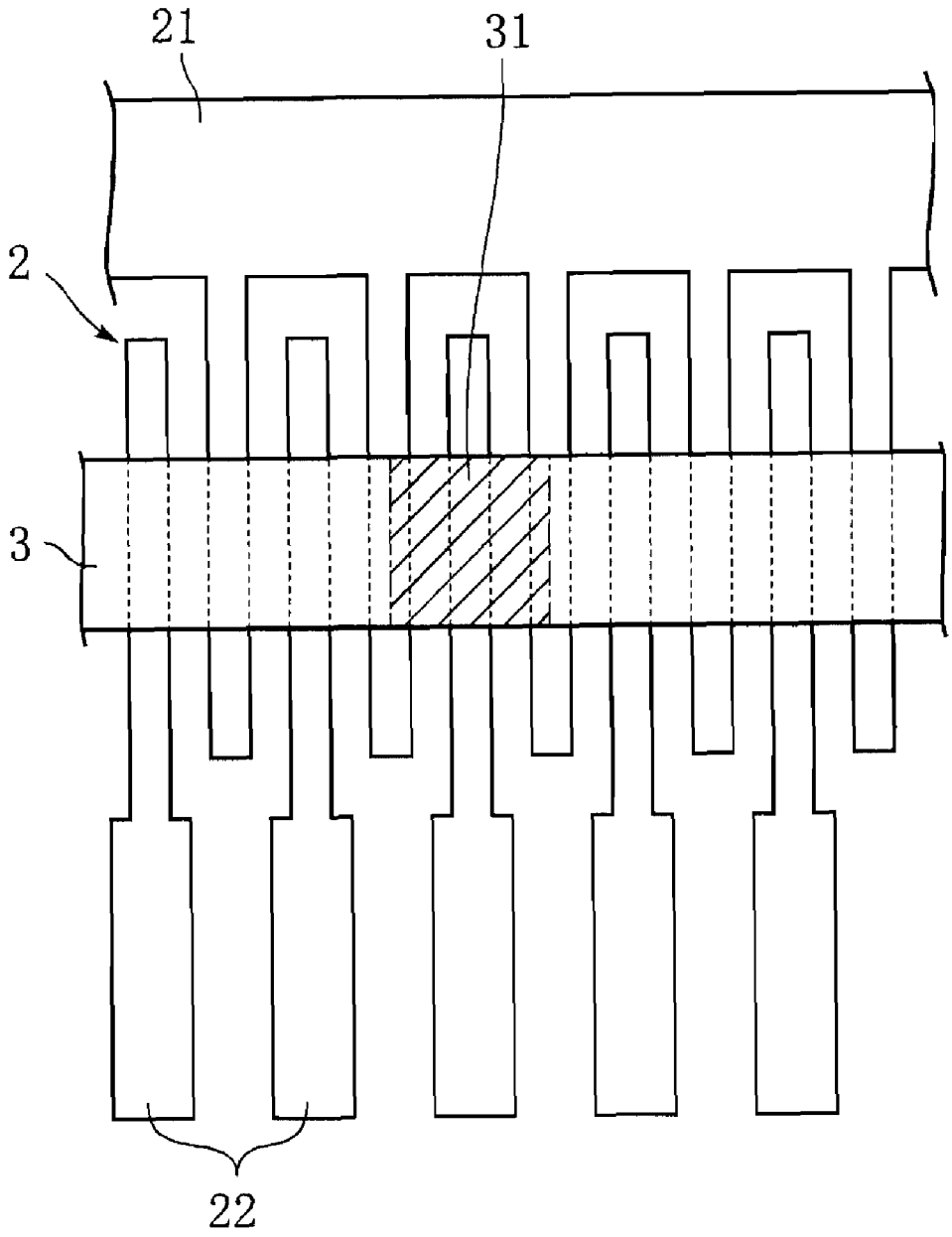
FIG. 5 is a plan view illustrating a heating resistor of the thermal printhead according to the first embodiment of the present invention.

As illustrated in FIG. 5, the electrode 2 is formed on the substrate 1. The electrode 2 serves to energize the heating resistor 3 and includes a common electrode 21 and a plurality of individual electrodes 22. The common electrode 21 includes a strip portion extending in the primary scanning direction, and a plurality of branch portions extending like comb-teeth in the secondary scanning direction and connected to the strip portion. The individual electrodes 22 include ends which are arranged alternately with the branch portions in the primary scanning direction. The electrode 2 is formed by e.g. thick film printing resinate Au paste and then baking the paste.

The heating resistor 3 is a heat source of the thermal printhead A1. The heating resistor 3 is in the form of a strip extending in the primary scanning direction as illustrated in FIG. 1 and extends across the branch portions of the common electrode 21 and the ends of the individual electrodes 22. When the common electrode 21 and any of the individual electrodes 22 are energized, the portion of the heating resistor 3 which is sandwiched between the branch portions and the above-described end is partially heated. This portion is called a heat portion 31. The heating resistor 3 provides a plurality of heat portions 31 arranged in the primary scanning direction. The heating resistor 3 is formed by e.g. thick film printing ruthenium oxide paste and then baking the paste.

The driver IC 4 energizes the heating resistor 3 via the common electrode 21 and the individual electrodes 22, thereby performing drive control to partially heat the heating resistor 3 (i.e., selectively heat a heat portion 31). In this embodiment, a plurality of driver ICs 4 are arranged on the substrate 1 in the primary scanning direction. The driver ICs 4 are covered by protective resin 41. The protective resin 41 is e.g. black resin and prevents damage to the driver ICs 4 and malfunction of the driver ICs caused by receiving ultraviolet light or the like.

Figure 7:
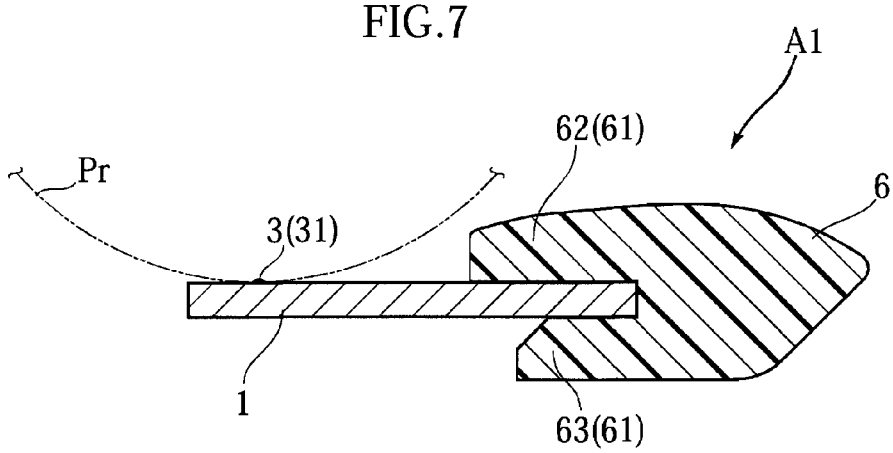
FIG. 7 is a sectional view taken along lines VII-VII in FIG. 1.

The cover 6 partially covers the driver ICs 4 and is made of a conductive resin prepared by mixing carbon in a black resin, for example. As illustrated in FIGS. 9-17, the cover 6 includes a pair of pinching portions 61. Each of the pinching portions 61 is made up of an upper piece 62 and a lower piece 63. As illustrated in FIG. 7, each of the pinching portions 61 pinches an end of the substrate 1 in the secondary scanning direction, whereby the cover 6 is fixed to the substrate 1. As illustrated in FIG. 1, the paired pinching portions 61 are spaced from each other in the primary scanning direction, with the driver ICs 4 interposed therebetween. In the secondary scanning direction, the pinching portions 61 (particularly the upper pieces 62) overlap the driver ICs 4.

Figure 8:
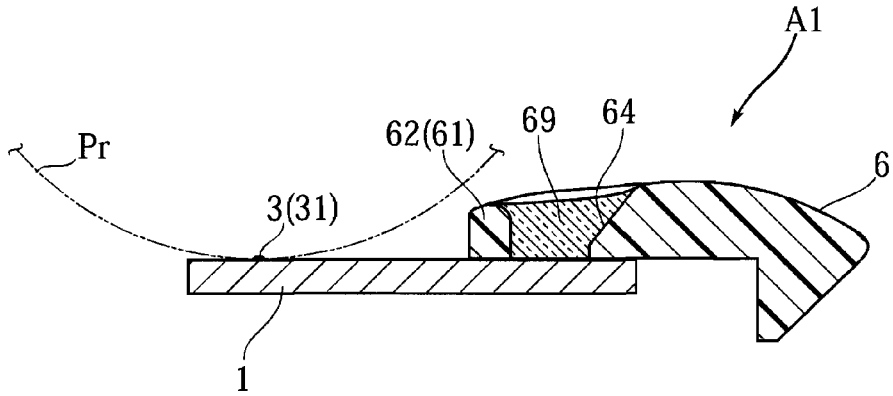
FIG. 8 is a sectional view taken along lines VIII-VIII in FIG. 1.
Figure 9:
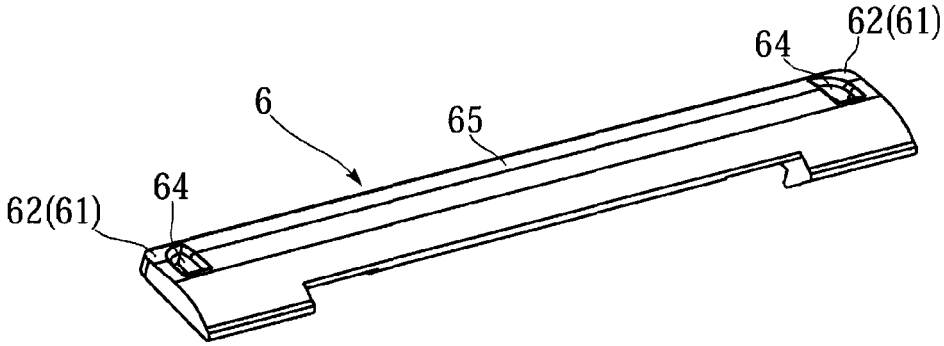
FIG. 9 is a perspective view illustrating a cover of the thermal printhead of FIG. 1.
Figure 10:
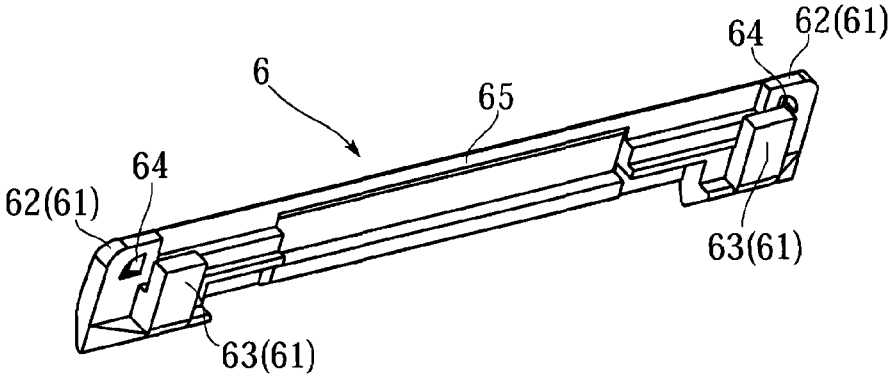
FIG. 10 is a perspective view illustrating the cover of the thermal printhead of FIG. 1.
Figure 11:
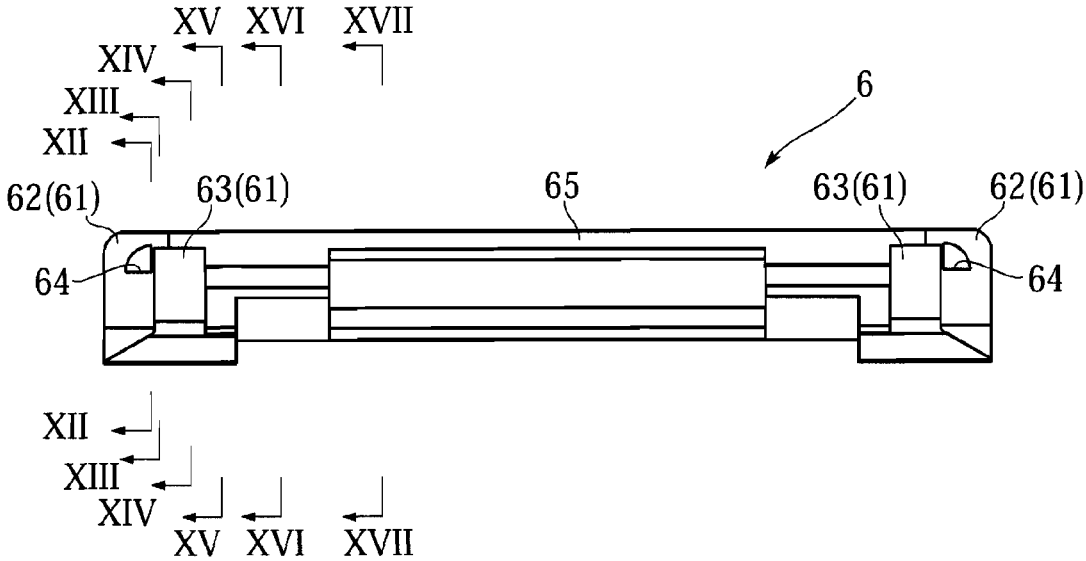
FIG. 11 is a bottom view illustrating the cover of the thermal printhead of FIG. 1.
Figure 12:
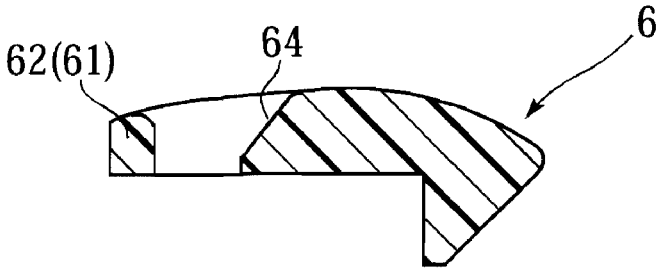
FIG. 12 is a sectional view taken along lines XII-XII in FIG. 11.
Figure 13:
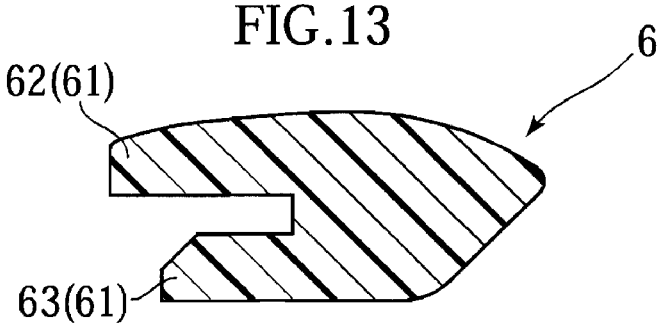
FIG. 13 is a sectional view taken along lines XIII-XIII in FIG. 11.
Figure 14:
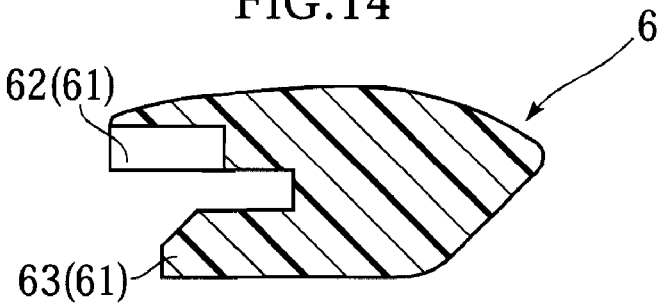
FIG. 14 is a sectional view taken along lines XIV-XIV in FIG. 11.
Figure 15:
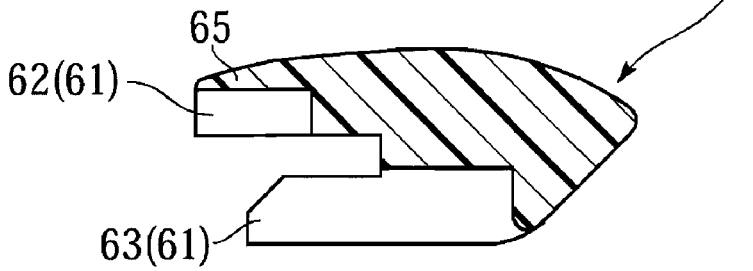
FIG. 15 is a sectional view taken along lines XV-XV in FIG. 11.
Figure 16:
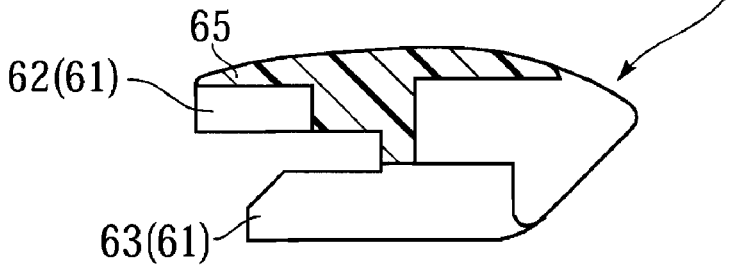
FIG. 16 is a sectional view taken along lines XVI-XVI in FIG. 11.
Figure 17:
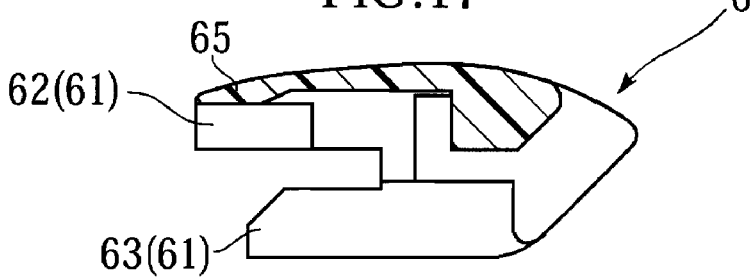
FIG. 17 is a sectional view taken along lines XVII-XVII in FIG. 11.

Each of the pinching portions 61 is formed with a through-hole 64. As illustrated in FIGS. 1 and 8, the through-hole 64 is formed to expose the surface of the substrate 1 on which the driver ICs 4 are mounted. In the thickness direction of the substrate 1, the through-hole 64 includes a portion which is positioned closer to the substrate 1 and has a relatively small cross sectional area and a portion which is farther from the substrate 1 and increases its cross sectional area as proceeding away from the substrate 1. In this embodiment, the through-hole 64 is filled with an adhesive material 69 such as an epoxy resin.

The substrate 1 is formed with an electrically conductive film 5. The electrically conductive film 5 is formed by using e.g. Ag paste and has a color which is lighter and closer to white than that of the surface of the substrate 1. The electrically conductive film 5 includes two end portions 52 and two edge portions 51. Each of the two end portions 52 is positioned on the outer side of the through-hole 64 in the primary scanning direction and in the form of a strip extending in the secondary scanning direction at an end of the substrate in the primary scanning direction. Each of the edge portions 51 is positioned closer to an end of the substrate 1 in the secondary scanning direction than the through-hole 64 is and in the form of a strip extending in the primary scanning direction at an end of the substrate in the secondary scanning direction. In the state in which the cover 4 is attached to the substrate 1, the pinching portions 61 pinch the substrate 1 together with the electrically conductive film 5, and the upper pieces 62 are pressed against the electrically conductive film 5. The electrically conductive film 5 is covered with a relatively thin insulating film to prevent short circuiting. Thus, the upper pieces 62 are pressed against the electrically conductive film 5 via the insulating film.

Figure 18:
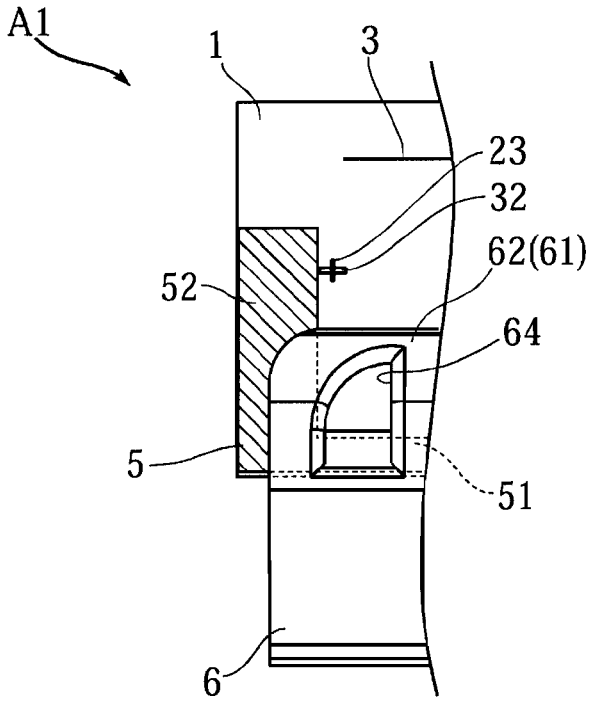
FIG. 18 is an enlarged plan view of a principal portion of the thermal printhead of FIG. 1, illustrating the state in which the substrate and the cover are properly positioned relative to each other.
Figure 19:
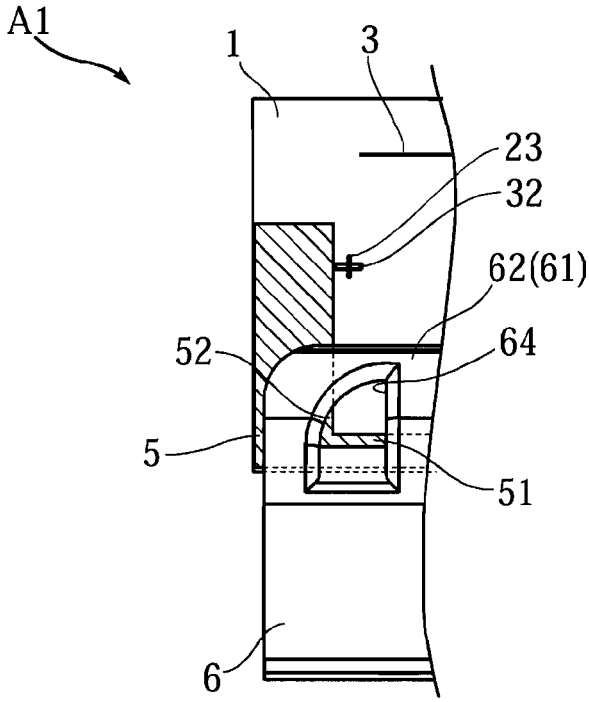
FIG. 19 is an enlarged plan view of a principal portion of the thermal printhead of FIG. 1, illustrating the state in which the substrate and the cover are not properly positioned relative to each other.

As illustrated in FIGS. 18 and 19, a resistor mark 32 and a conductor mark 23 are provided adjacent to the end portion 52. The resistor mark 32 is formed by e.g. thick film printing ruthenium oxide paste and then baking the paste, similarly to the heating resistor 3 and in the same process as the heating resistor 3. The conductive mark 23 is formed by using e.g. resinate Au paste, similarly to the electrode 2 and in the same process as the electrode 2. The resistor mark 32 and the conductor mark 23 both have a short linear shape and cross each other at right angles. By performing e.g. image processing with respect to the resistor mark 32 and the conductor mark 23, the precise positions of the electrode 2 and the heating resistor 3, and further, the precise position at which a printing dot is formed can be recognized. This provides benefits to the manufacturing process and the testing process of the thermal printhead A1.

Figure 6:
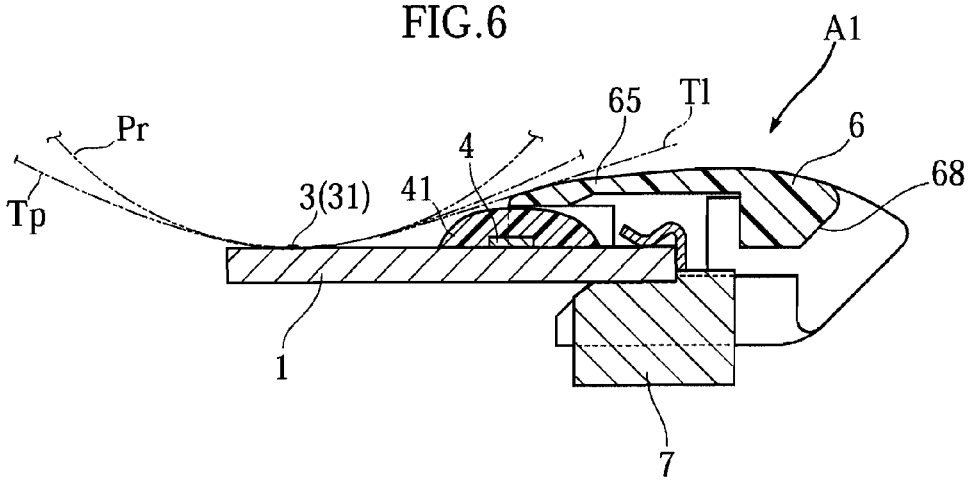
FIG. 6 is a sectional view taken along lines VI-VI in FIG. 1.

As illustrated in FIGS. 9-17, the cover 6 includes a thin-wall portion 65. The thin-wall portion 65 is positioned between the pinching portions 61 and considerably thinner than the pinching portions 61. In this embodiment, as illustrated in FIG. 6, the thin-wall portion 65 is shaped and arranged like eaves which partially cover the driver ICs 4. The cover 6 is further formed with an inclined portion 68. The inclined portion 6 is so inclined as to be positioned upward in the figure as proceeding away from the connector toward the right in the figure. The provision of the inclined portion 6 prevents fingers from interfering with the cover 6 in inserting e.g. a flat cable into the connector 7.

As illustrated in FIGS. 1-8, the connector 7 is attached to the substrate 1 at an end in the secondary scanning direction. In the primary scanning direction, the connector 7 is positioned between the paired pinching portions 61. In incorporating the thermal printhead A1 into a printer, the connector 7 is connected to a connector (not shown) attached to a cable (not shown). A pin included in the connector 7 is used as a so-called ground line which is set in using the printer. The electrically conductive film 5 and the common electrode 21 are connected to the ground line.

The advantages of the thermal printhead A1 are described below.

According to this embodiment, the cover 6 is attached to an end of the substrate 1 in the secondary scanning direction by the paired pinching portions 61. Thus, the parts for fixing the cover 6, like the screw 98 or the heat dissipation plate 91 illustrated in FIG. 20, do not need to be provided as the structural part. Thus, the number of structural parts of the thermal printhead A1 reduces. Further, since it is not necessary to secure the space for fastening the screw 98, the thermal printhead A1 is reduced in size.

Since the pinching portions 61 are arranged at positions avoiding the driver ICs 4, it is possible to make the pinching portions 61 relatively thick and hence strong, which is suitable for reliable fixation of the cover 6 to the substrate 1. Of the cover 6, the portion which overlaps the driver ICs 4 in the primary scanning direction is the thin-wall portion 65 which is shaped like eaves. As illustrated in FIG. 6, thermal paper Tp is pressed against the heating resistor 3 by the platen roller Pr. At least during the printing process, the platen roller Pr is at a fixed position relative to the thermal printhead A1, and the thermal paper Tp proceeds to the thermal printhead A1 at a substantially constant angle. The interference between the thermal paper Tp and the cover 6 occurs more easily in a smaller thermal printhead A1. In this embodiment, such interference with the thermal paper Tp is avoided by arranging the thin-wall portion 65 to partially overlap the driver ICs in the secondary scanning direction. As illustrated in FIG. 6, when the tangent to the thin-wall portion 65 of the cover 6 at a position close to the platen roller Pr is expressed as tangent T1, it is preferable that the protective resin 41 does not project toward the platen roller Pr beyond the tangent T1. This arrangement prevents the protective resin 41 from interfering with the platen roller Pr or the thermal paper Tp.

As illustrated in FIG. 18, when the cover 6 is attached to a proper position of the substrate 1, neither the edge portion 51 nor the end portion 52 of the electrically conductive film 5 is exposed through the through-hole 64. By contrast, as illustrated in FIG. 19, when the pushing of the cover 6 in the secondary scanning direction is insufficient, part of the edge portion 51 is exposed through the through-hole 64. When the cover 6 is attached to the substrate 1 at a position which is deviated from the proper position in the primary scanning direction, one of the end portions 52 is exposed through the corresponding through-hole 64. Thus, by visually checking whether or not part of the electrically conductive film 5 is exposed through the through-hole 64, whether or not the cover is attached properly can be easily determined. Since part of the through-hole 64 is so shaped as to gradually increase its cross sectional area as noted before, the exposure of the electrically conductive film 5 can be visually checked easily even from an oblique direction. The lighter color of the electrically conductive film 5 which is different from the color of the substrate 1 in lightness and chroma is suitable for the visual checking. Further, when an ultraviolet curing resin is used as the adhesive material 69, the shape of the through-hole 64 having a gradually increasing cross sectional makes it possible to irradiate the entirety of the adhesive material 69 with ultraviolet light.

As illustrated in FIGS. 18 and 19, the electrically conductive film 5 exists between the cover 6 and the substrate 1 at certain locations. Thus, a gap substantially corresponding to the thickness of the electrically conductive film 5 is defined between the cover 6 and the substrate 1 at a region where the electrically conductive film 5 does not exist. The portion around the through-hole 64 is included in this region. Thus, in loading the adhesive material 69 into the through-hole 64, the adhesive material 69 can enter the gap between the cover 6 and the substrate 1, whereby the bonding strength between the cover 6 and the substrate 1 increases.

Further, since the cover 6 is made of a conductive resin, even if unintentional friction between the thermal paper Tp and the cover occurs, build-up of static electricity on the cover 6 is prevented.

Filling the through-hole 64 with the adhesive material 69 contributes to reliable fixing of the cover 6 to the substrate 1.

Arranging the connector 7 between the paired pinching portions 61 is suitable for the size reduction of the thermal printhead A1.

Figure 20:
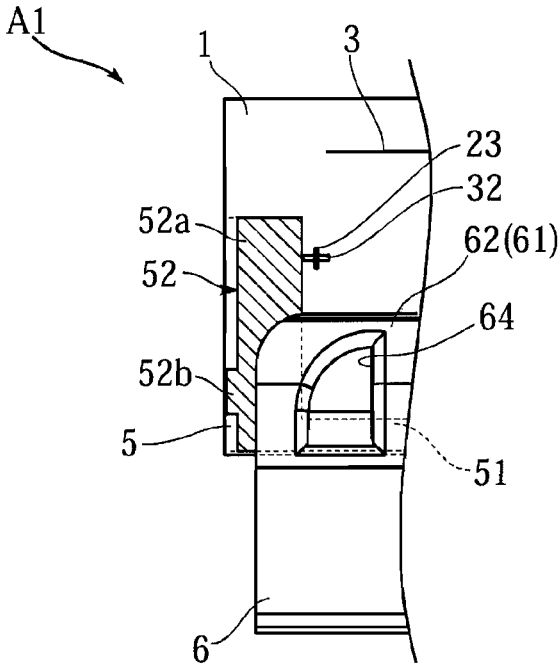
FIG. 20 is a plan view illustrating a principal portion of a variation of an electrically conductive film of the thermal printhead according to the first embodiment of the present invention.

FIG. 20 illustrates a variation of the electrically conductive film 5. This variation differs from the foregoing embodiment in structure of the end portions 52. Specifically, most part of the end portions 52 is slightly spaced from an end surface of the substrate 1, or the left end surface in this figure. More specifically, each end portion 52 includes a retreated portion 52*a* and an extension 52*b*. The retreated portion 52*a* is the portion provided at a position slightly retreated from the left end surface of the substrate 1 in the figure. The extension 52*b* is a portion extending from the retreated portion 52*a* to reach the left end surface of the substrate 1 in the figure.

In the manufacture of a thermal printhead A1, a plurality of substrates 1 are obtained by dividing a relatively large material board. Specifically, in the state of the material board, a conductor pattern, which is to become the electrodes 2 and the electrically conductive films 5, and heating resistors 3 are formed, and driver ICs are mounted. In the material board, adjacent end portions 52 of two adjacent substrates 1 are connected to each other at the respective extensions 52*b* and hence electrically connected to each other. In this way, all the end portions 52 in the material board are electrically connected to each other. Thus, to check the conduction of the individual electrodes 22 and so on in the state of the material board, continuity test with respect to all the individual electrodes 22 can be performed by bringing a probe of a tester into contact with one of the end portions 52.

After the continuity testis finished, the material board is divided into a plurality of substrates 1, and in this process, two extensions 52*b* connected to each other are divided at the boundary. However, the retreated portion 52*a*, which constitutes most part of the end portion 52, is not divided. Thus, in the process of dividing the material board, formation of a crack in the end portion 52 is prevented.

Figure 21:
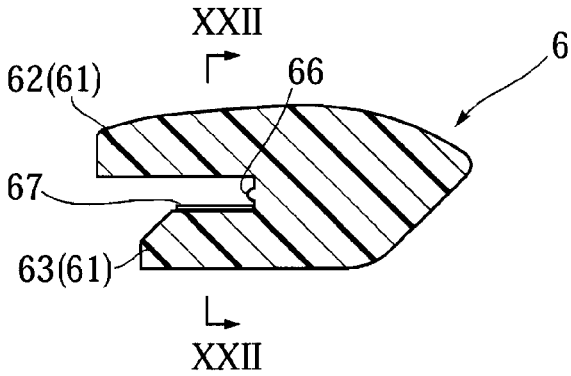
FIG. 21 is a sectional view illustrating a variation of the cover of the thermal printhead according to the first embodiment of the present invention.
Figure 22:
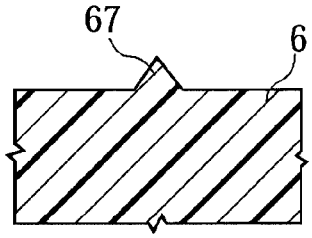
FIG. 22 is a sectional view of a principal portion taken along lines XXII-XXII in FIG. 21.

FIGS. 21 and 22 illustrate a variation of the cover 6. The cover 6 of this variation includes a point projection 66 and a linear projection 67. The point projection 66 is formed at a portion of the cover 6 against which an end surface of the substrate 1 is to be pressed. Specifically, the cover 6 is formed with about two or three point projections 66 arranged at predetermined intervals in the longitudinal direction of the substrate 1. The point projections 66, which may be two or three, for example, support the end surface of the substrate 1. This arrangement is useful for reliably attaching the cover 6 in parallel to the substrate 1.

The linear projection 67 is provided at the lower piece 63 of each pinching portion 61. The linear prof ection 67 extends in a direction in which the substrate 1 is pushed to the cover 6. The linear projection 66 may be triangular in cross section, as illustrated in FIG. 22. When the substrate 1 enters the pinching portion 61, the linear projection 67 is elastically deformed. The deformation increases the pinching force of the pinching portion 61, so that the cover 6 is strongly secured to the substrate 1.

FIGS. 23-28 illustrate other embodiments of the present invention. In these embodiments, the elements which are identical or similar to those of the foregoing embodiment are designated by the same reference signs as those used for the foregoing embodiment.

Figure 23:
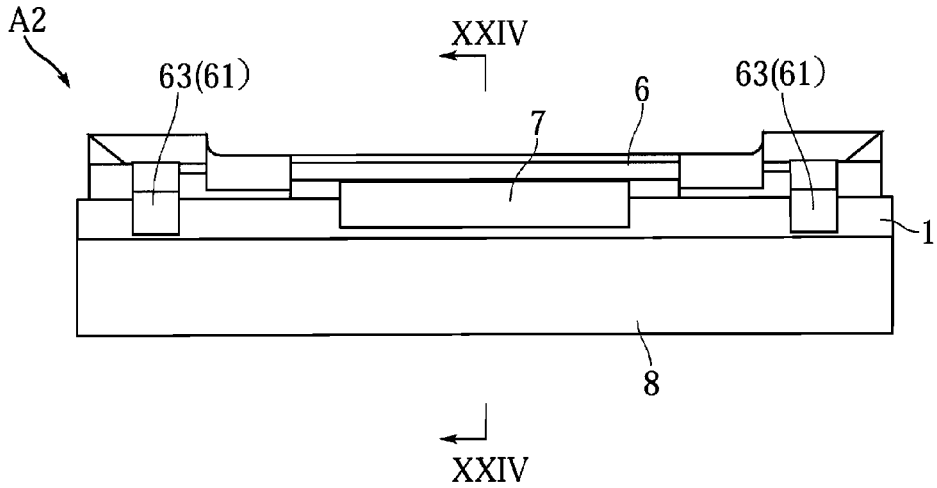
FIG. 23 is a bottom view illustrating a thermal printhead according to a second embodiment of the present invention.
Figure 24:
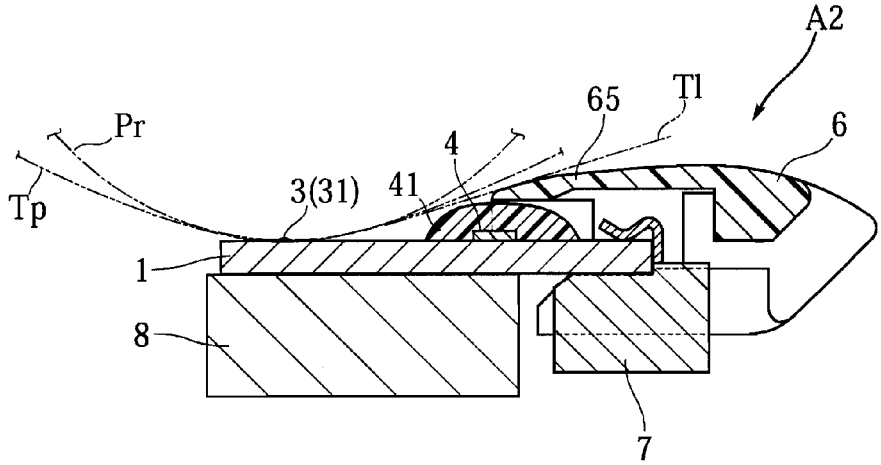
FIG. 24 is a sectional view of a principal portion taken along lines XXIV-XXIV in FIG. 23.

FIGS. 23 and 24 illustrate a thermal printhead according to a second embodiment of the present invention. The thermal printhead A2 of this embodiment differs from the foregoing embodiment in that a heat dissipation plate 8 is provided. The heat dissipation plate 8 is in the form of an elongated rectangle as illustrated in FIG. 23 and attached to the reverse surface of the substrate 1 as illustrated in FIG. 24. The heat dissipation plate 8 is made of a material having a thermal conductivity higher than that of the substrate 1, and specifically, made of aluminum, for example. In this embodiment, most part of the reverse surface of the substrate 1 is covered with the heat dissipation plate 8 except the portion where the connector 7 is provided and the portions which the pinching portions 63 are in contact with. While the substrate 1 has a thickness of e.g. about 1 mm, the heat dissipation plate 8 has a relatively large thickness of about 4 mm.

According to this embodiment again, the thermal printhead A2 can be made compact while avoiding the interference with the platen roller Pr or the thermal paper Tp. The provision of the heat dissipation plate 8 prevents heat from being retained in the substrate 1. This enhances the operation stability of the thermal printhead A2 and hence contributes to an increase in the printing speed.

Figure 25:
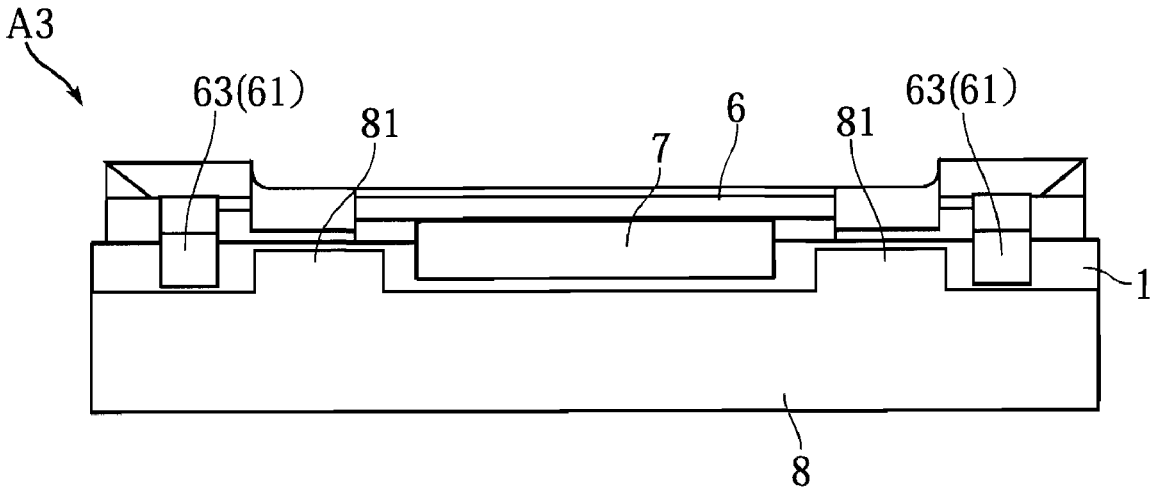
FIG. 25 is a bottom view illustrating a thermal printhead according to a third embodiment of the present invention.

FIG. 25 illustrates a thermal printhead according to a third embodiment of the present invention. The thermal printhead A3 of this embodiment differs from the thermal printhead A2 in structure of the heat dissipation plate 8. Specifically, the heat dissipation plate 8 of this embodiment is formed with two extensions 81. Each of the extensions 81 is positioned between the lower piece 63 of the adjacent pinching portion 61 and the connector 7.

This embodiment achieves more efficient heat dissipation from the substrate 1 and is suitable to enhance the operation stability of the thermal printhead A3 and increase the printing speed.

Figure 26:
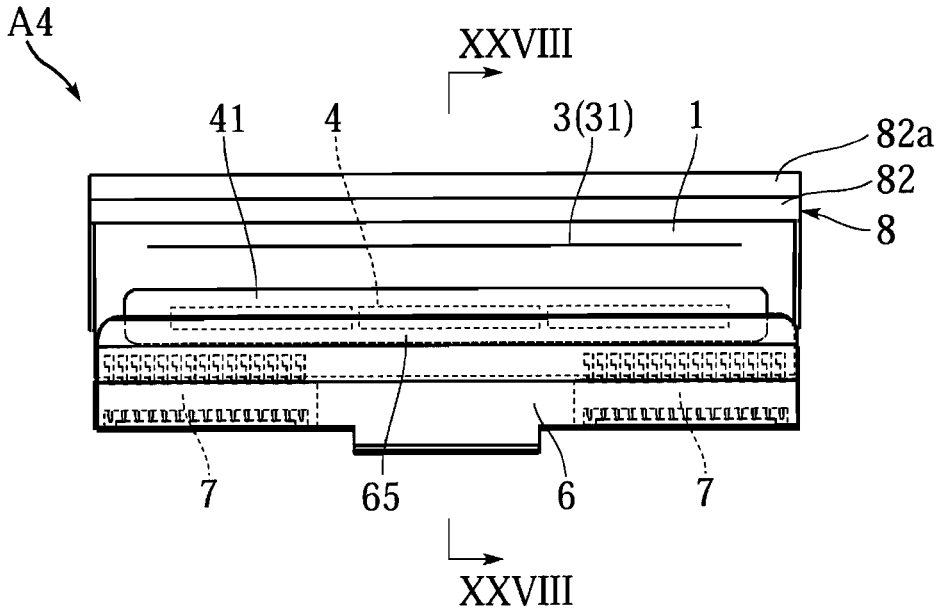
FIG. 26 is a plan view illustrating a thermal printhead according to a fourth embodiment of the present invention.
Figure 27:
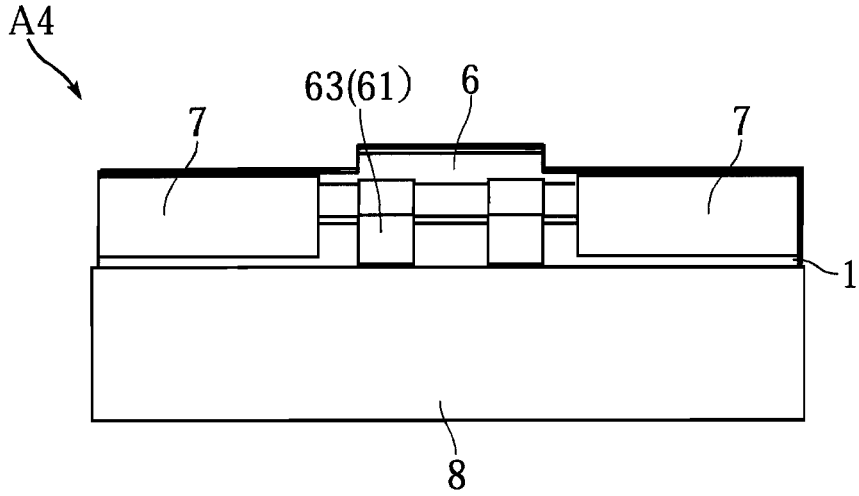
FIG. 27 is a bottom view illustrating a thermal printhead according to a fourth embodiment of the present invention.
Figure 28:
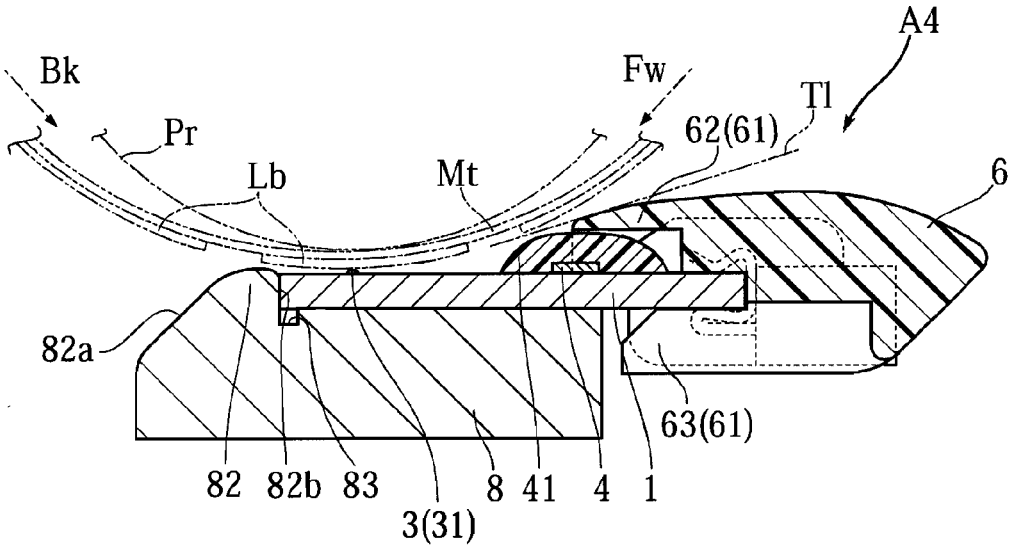
FIG. 28 is a sectional view taken along lines XXVIII-XXVIII in FIG. 26.
Figure 29:
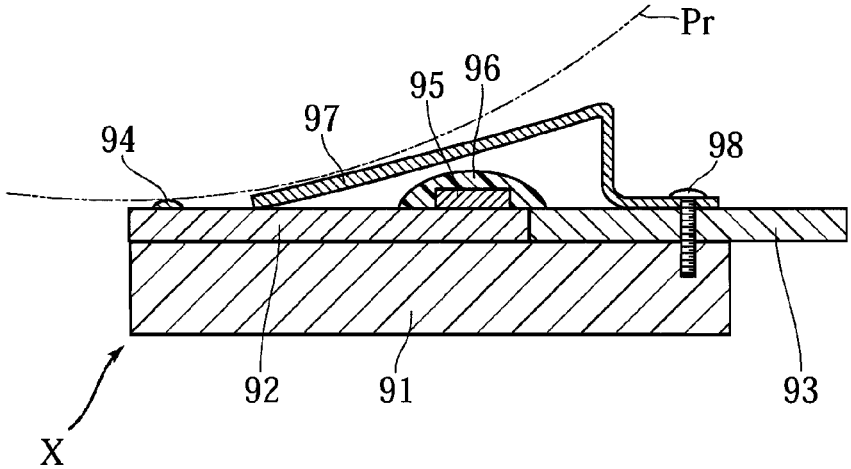
FIG. 29 is a sectional view illustrating an example of conventional thermal printhead.

FIGS. 26-28 illustrate a thermal printhead according to a fourth embodiment of the present invention. The thermal printhead A3 of this embodiment differs from the foregoing embodiments in arrangement of the connector 7 and structure of the heat dissipation plate 8.

In this embodiment, as illustrated in FIG. 26, two connectors 7 spaced from each other are arranged adjacent to two ends of the substrate 1. As illustrated in FIG. 27, the pinching portions 61 of the cover 6 are arranged between the two connectors 7.

As illustrated in FIG. 28, the heat dissipation plate 8 includes a portion sticking out to the left of the substrate 1 in the figure and is formed with a bulging portion 82 and a groove 83. The bulging portion 82 adjoins the left end surface of the substrate 1 in the figure and bulges upward in the figure.

In this embodiment, the apex of the bulging portion 82 is positioned higher than the upper surface of the substrate 1 by about 0.1 to 0.15 mm. The part of the bulging portion 82 near the apex has a smooth arcuate cross sectional shape. The bulging portion 82 includes an inclined surface 82*a* and a side surface 82*b*. The inclined surface 82*a* extends from the apex of the bulging portion 82 obliquely to the lower left in the figure. The side surface 82*b* stands vertically in the figure and faces the left end surface of the substrate 1.

The groove 83 is connected to the lower end of the side surface 82*b* and is e.g. rectangular in cross section. The groove 83 is covered by an end portion of the substrate 1. The heat dissipation plate 8 and the substrate 1 are bonded together with e.g. an adhesive tape (not shown) having a relatively high thermal conductivity.

In this embodiment, the platen roller Pr has a diameter of not more than about 20 mm, specifically, about 16 mm for example, and the distance between the apex of the bulging portion 82 and the heating resistor 3 is set to about 3.2 mm.

FIG. 28 illustrates the printing by the thermal printhead A4 on a label printing sheet, i.e., a sheet made up of a backing sheet Mt and a plurality of labels arranged on the backing sheet Mt. In printing on the labels Lb, the backing sheet Mt carrying the labels Lb is transferred in the forward direction Fw. Once printing on the labels Lb is finished, the backing sheet Mt is transferred in the forward direction Fw until all the printed labels Lb are discharged from e.g. the printer incorporating the thermal printhead A4. The printed labels Lb are thereafter peeled off from the backing sheet Mt.

Generally, in discharging the printed labels Lb from the printer, unprinted labels Lb are also transferred together downstream in the direction Fw of the thermal printhead A4. Thus, so as not to waste labels, it is desirable, in starting the next printing on labels Lb, to transfer the sheet back in the reverse direction Bk until the unprinted label located at the front comes to the printing position of the thermal printhead A4. In this process, even if the label Lb is slightly peeled off from the backing sheet Mt, the label Lb moves smoothly while sliding over the inclined surface 82*a* and the apex of the bulging portion 82 of the heat dissipation plate 8. Moreover, since the substrate 1 is positioned slightly lower than the bulging portion 82, the label Lb is not easily jammed against the substrate 1. Thus, the backing sheet Mt carrying the labels Lb is properly transferred in the reverse direction. Thus, the thermal printhead enables printing on labels Lb without wasting labels Lb.

The provision of the groove 83 prevents undesirable interference between the corner portion of the substrate 1 on the lower left in the figure and the heat dissipation plate 8 is prevented.

The thermal printhead according to the present invention is not limited to the foregoing embodiments. The specific structure of each part of the thermal printhead according to the present invention may be varied in design in various ways.

For instance, the present invention is not limited to the arrangement in which each of the paired pinching portions is formed with a through-hole 64. Instead, only one of the pinching portions may be formed with a through-hole 64. Further, the thermal printhead may be so designed that the electrically conductive film 5 is exposed through only one of the paired through-holes 64 when the position of the cover 6 is deviated.

The structure of the electrode 2 and the heating resistor 3 is not limited to those described above. For instance, the comb-teeth portions of the common electrode 21 and the individual electrodes 22 may face each other across a space in the secondary scanning direction, with the heating resistor 3 arranged between them. The heating resistor in the present invention is not limited to that in the form of a single strip extending in the primary scanning direction. The heating resistor in the present invention may be made up of a plurality of elements arranged in the primary scanning direction and each having a size corresponding to one print dot.

The invention claimed is:

1. A thermal printhead comprising:

a substrate;

a heating resistor formed on the substrate and elongated in a primary scanning direction;

a driver IC provided on the substrate to partially heat the heating resistor, the driver IC being spaced apart from the heating resistor in a secondary scanning direction perpendicular to the primary scanning direction; and a cover covering at least part of the driver IC;

wherein the cover includes a pair of pinching portions separate and spaced from each other in the primary scanning direction, each of the pinching portions being configured to pinch the substrate in a thickness direction of the substrate perpendicular to both the primary scanning direction and the secondary scanning direction.

2. The thermal printhead according to claim 1, wherein the substrate includes two ends spaced apart from each other in the secondary scanning direction, and the pinching portions pinch one of the two ends of the substrate.

3. The thermal printhead according to claim 1, wherein the pinching portions are so arranged that the driver IC is sandwiched between the pinching portions in the primary scanning direction.

4. The thermal printhead according to claim 3, wherein the pinching portions, as viewed in the primary scanning direction, overlap the driver IC in the secondary scanning direction.

5. The thermal printhead according to claim 1, wherein at least one of the pinching portions is formed with a through-hole for exposing a surface of the substrate on which the driver IC is provided.

6. The thermal printhead according to claim 5, wherein the surface of the substrate on which the driver IC is provided is formed with an electrically conductive film that includes: a portion positioned closer, in the secondary scanning direction, to an end of the surface than the through-hole is; and a portion positioned on an outer side of the through-hole in the primary scanning direction; the electrically conductive film being different from the substrate in at least one of hue, chroma and lightness.

7. The thermal printhead according to claim 6, wherein the through-hole includes a portion having a cross sectional area that increases as proceeding away from the substrate in the thickness direction of the substrate.

8. The thermal printhead according to claim 6, wherein the electrically conductive film is electrically connected to a ground line, and at least one of the pinching portions pinches the substrate together with the electrically conductive film.

9. The thermal printhead according to claim 6, wherein the portion positioned on an outer side of the through-hole in the primary scanning direction includes: a retreated portion provided at a position retreated from an end of the substrate in the primary scanning direction; and an extension extending from the retreated portion to reach the end of the substrate in the primary scanning direction.

10. The thermal printhead according to claim 5, wherein the through-hole is filled with adhesive material.

11. The thermal printhead according to claim 1, wherein the cover includes a thin-wall portion positioned between the pinching portions in the primary scanning direction, the thin-wall portion covering at least part of the driver IC and being smaller in thickness than the pinching portions.

12. The thermal printhead according to claim 1, further comprising a connector provided at an end of the substrate in the secondary scanning direction, wherein the connector is electrically connected to the driver IC, and positioned between the pinching portions in the primary scanning direction.

13. The thermal printhead according to claim 12, wherein the cover includes an inclined portion, the inclined portion being so inclined that, at a position farther from the connector in the secondary scanning direction, the inclined surface is farther from the connector in a normal direction of a surface of the substrate on which the heating resistor is formed.

14. The thermal printhead according to claim 13, wherein the heat dissipation plate is provided at a position avoiding the pinching portions.

15. The thermal printhead according to claim 1, further comprising a heat dissipation plate attached to a surface of the substrate opposite to the surface on which the heating resistor is formed.

16. The thermal printhead according to claim 15, wherein the heat dissipation plate is formed with a bulging portion positioned downstream from the substrate in a printing direction and projecting in a normal direction of the surface of the substrate on which the heating resistor is formed.

17. The thermal printhead according to claim 16, wherein the bulging portion projects beyond the substrate in the normal direction.

18. The thermal printhead according to claim 16, wherein the bulging portion is formed with an inclined surface that is so inclined as to be deviated toward an opposite of the normal direction as proceeding downstream in the printing direction.

19. The thermal printhead according to claim 16, wherein the bulging portion is formed with a side surface oriented upstream in the printing direction and facing an end surface of the substrate.

20. The thermal printhead according to claim 19, wherein the heat dissipation plate is formed with a groove that is positioned on an opposite side of the normal direction with respect to the side surface and caves in a direction opposite the normal direction.

* * * * *